US007307207B1

(12) United States Patent
Davis

(10) Patent No.: US 7,307,207 B1
(45) Date of Patent: Dec. 11, 2007

(54) MUSIC PAGE TURNING APPARATUS

(76) Inventor: Gregg R. Davis, 1219 Slayton Dr., Manteca, CA (US) 95336

( * ) Notice: Subject to any disclaimer, the term of this patent is extended or adjusted under 35 U.S.C. 154(b) by 0 days.

(21) Appl. No.: 11/548,221

(22) Filed: Oct. 10, 2006

(51) Int. Cl.
*G10G 7/00* (2006.01)

(52) U.S. Cl. ..... 84/504

(58) Field of Classification Search ..... 84/486, 84/487–494, 502–506, 508–514
See application file for complete search history.

(56) References Cited

U.S. PATENT DOCUMENTS 1,883,034 A 10/1932 Snively et al.
2,601,047 A * 6/1952 Merrion ..... 40/531
3,570,154 A * 3/1971 Cosenza ..... 40/475
3,665,093 A 5/1972 Machnacz
4,463,651 A * 8/1984 Hammer ..... 84/504
5,373,772 A 12/1994 Shemoul

* cited by examiner

*Primary Examiner*—Kimberly Lockett
(74) *Attorney, Agent, or Firm*—Crossley Patent Law; Mark Ashley Crossley

(57) ABSTRACT

A music page turning apparatus is disclosed. One embodiment provides a music page turning apparatus for fit to an existing music platform or the like. Another embodiment provides a complete music stand equipped with the apparatus. The control is remotely locatable from the motor unit such that foot control is invited in turning the pages either forwardly or in reverse. Each depression of the forward or the reverse switch turns one page.

19 Claims, 6 Drawing Sheets

MUSIC PAGE TURNING APPARATUS

BACKGROUND OF THE INVENTION

It has long been established that page turning of music, without a musician having to use their hands, is highly desirable. It stands to reason that foot operation of a page turning device is desirable, so that hands remain free. It is also desirable for a page turner to turn pages in both directions. With the progression of electronics, computers, and mechanical devices, a newer page turning device, employing these advantages of progression, is needed. The prior art does not incorporate the advantages and capabilities of the present apparatus.

1. Field of the Invention

The music page turning apparatus relates to music page turners and more especially to a music page turning apparatus that is provided in two embodiments, one as an addition to an existing music stand and a second embodiment which is complete with a music stand and platform.

2. Description of the Prior Art

Prior related art U.S. Pat. No. 1,883,034 issued to Snively et al. on Oct. 18, 1932 teaches a music leaf turner comprised of an electromagnet and associated hardware. The mechanical design and components of the device are unlike the electric motor and foot switch of the present apparatus. U.S. Pat. No. 3,665,093 issued to Machnacz on May 23, 1972 teaches a page turner for sheet music and the like. The cord and pulley mechanics are unlike the motor drive components of the present apparatus. U.S. Pat. No. 5,373,772 issued to Shemoul on Dec. 20, 1994 teaches a page turner which, unlike the present apparatus, requires that a transparency accompany each page of music.

While the above-described devices fulfill their respective and particular objects and requirements, they do not describe a music page turning apparatus that provides for the advantages of the music page turning apparatus. In this respect, the music page turning apparatus substantially departs from the conventional concepts and designs of the prior art.

Therefore, a need exists for an improved music page turning apparatus.

SUMMARY OF THE INVENTION

The general purpose of the music page turning apparatus, described subsequently in greater detail, is to provide a music page turning apparatus which has many novel features that result in an improved music page turning apparatus which is not anticipated, rendered obvious, suggested, or even implied by prior art, either alone or in combination thereof.

To attain this, the music page turning apparatus is provided in various embodiments. One embodiment provides the apparatus as a removable addition to a music platform. The apparatus is selectively fitted to the top of the platform. The spring clips of the arms of the motor unit are clipped to music pages. The control for the motor unit is preferably foot operated but easily capable of operation via other means. The control provides forward and reverse page turning of the motor unit. The user can thereby select direction of page turning and number of pages turned, with each switch depression affecting a single page turn. The plurality of arms of the motor unit provide for turning numerous pages before resetting the spring clips to other pages, if needed. The u-clamp provides for fit to any number of a variety of variations in music stand platforms. The slim design of the u-clamp also provides for music pages to rest over the u-clamp as needed.

Another embodiment of the apparatus provides a complete adjustable music stand with folding leg support. The platform of the stand is fitted with the page turning motor unit. The control communicates with the motor unit. The control and motor unit operate in the same fashion as the above-described embodiment. Either embodiment is provided in outlet powered or battery powered configuration. The apparatus provides a basic, inexpensively manufactured solution to the turning of music pages for a musician.

Thus has been broadly outlined the more important features of the improved music page turning apparatus so that the detailed description thereof that follows may be better understood and in order that the present contribution to the art may be better appreciated.

An object of the music page turning apparatus is to provide a basic solution to music page turning needs.

Another object of the music page turning apparatus is to provide a solution to music page turning needs that is selectively fitted to an existing platform.

A further object of the music page turning apparatus is to provide a music page turning apparatus complete with music platform with stand.

An added object of the music page turning apparatus is to provide page turning for a plurality of music pages.

And, an object of the music page turning apparatus is to bidirectional music page turning.

Yet another object of the music page turning apparatus is to provide for foot operated control.

Still another object of the music page turning apparatus is to provide for easy removable attachment to music pages.

These together with additional objects, features and advantages of the improved music page turning apparatus will be readily apparent to those of ordinary skill in the art upon reading the following detailed description of presently preferred, but nonetheless illustrative, embodiments of the improved music page turning apparatus when taken in conjunction with the accompanying drawings.

In this respect, before explaining the current embodiments of the improved music page turning apparatus in detail, it is to be understood that the music page turning apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved music page turning apparatus. It is therefore important that the claims be regarded as including such equivalent constructions insofar as they do not depart from the spirit and scope of the music page turning apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 6 thereof, the principles and concepts of the music page turning apparatus generally designated by the reference number 10 will be described.

Figure 1:
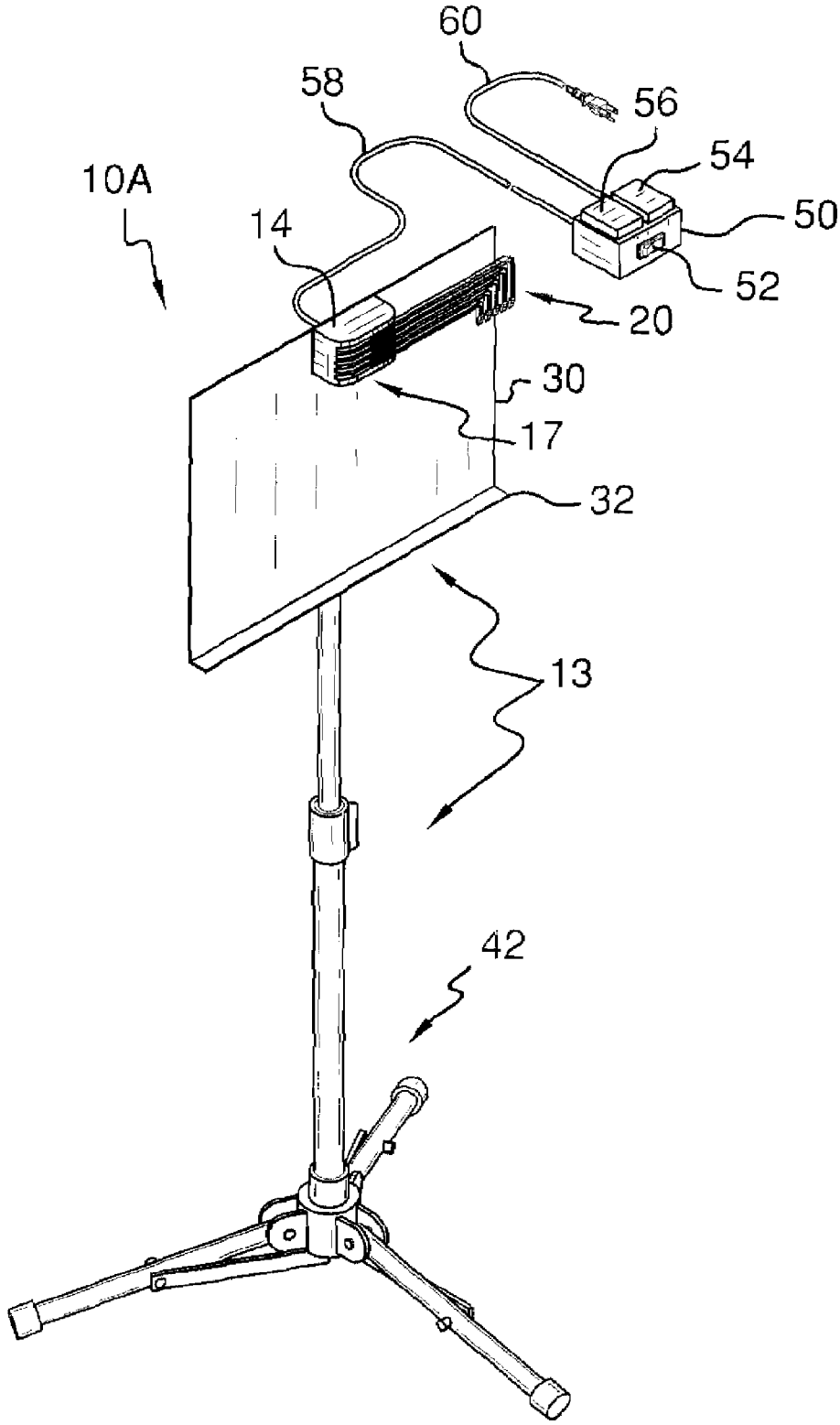
FIG. 1 is a perspective view of one embodiment of the apparatus.
Figure 2:
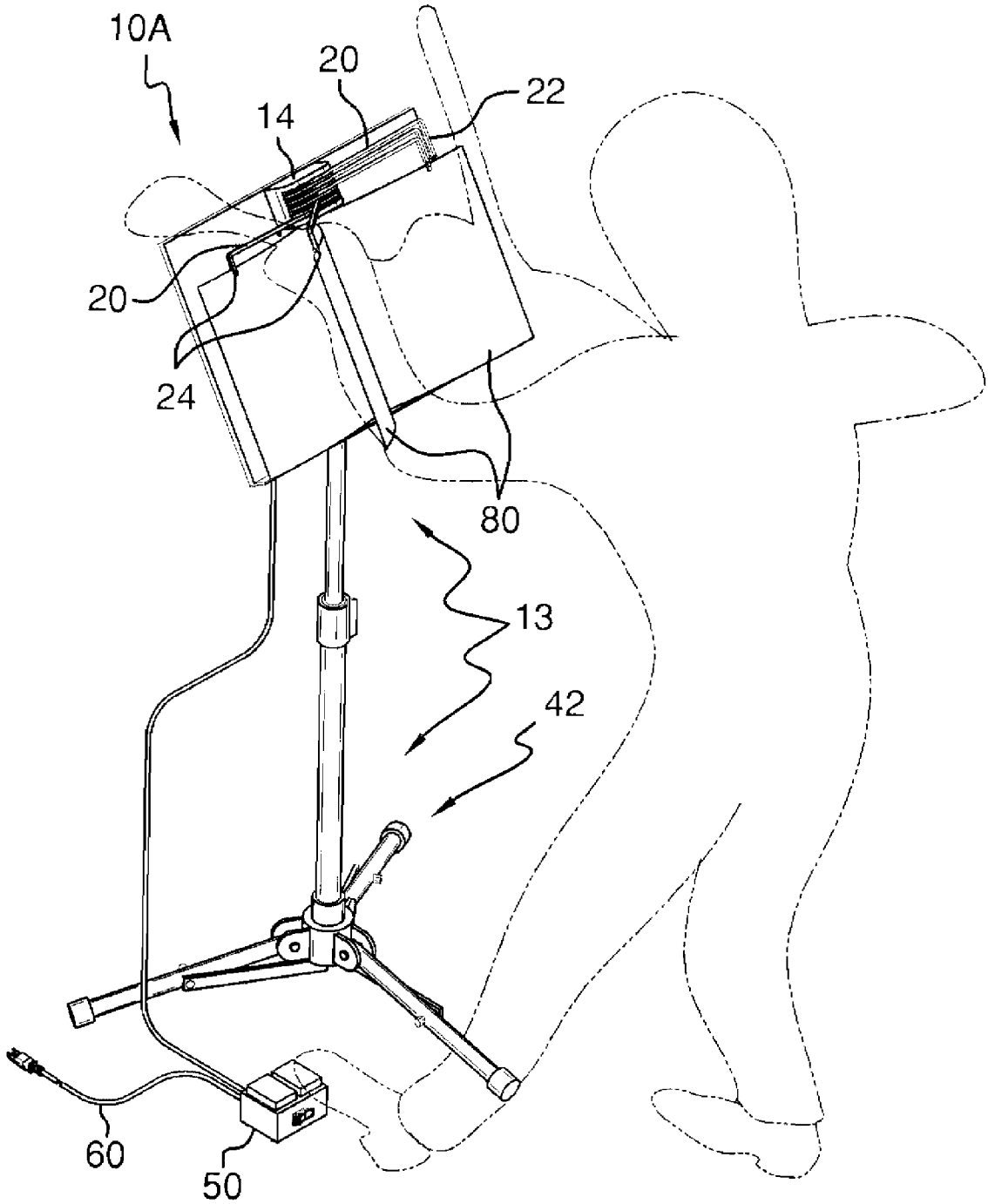
FIG. 2 is a left isometric view of the apparatus of FIG. 1 in use.
Figure 3:
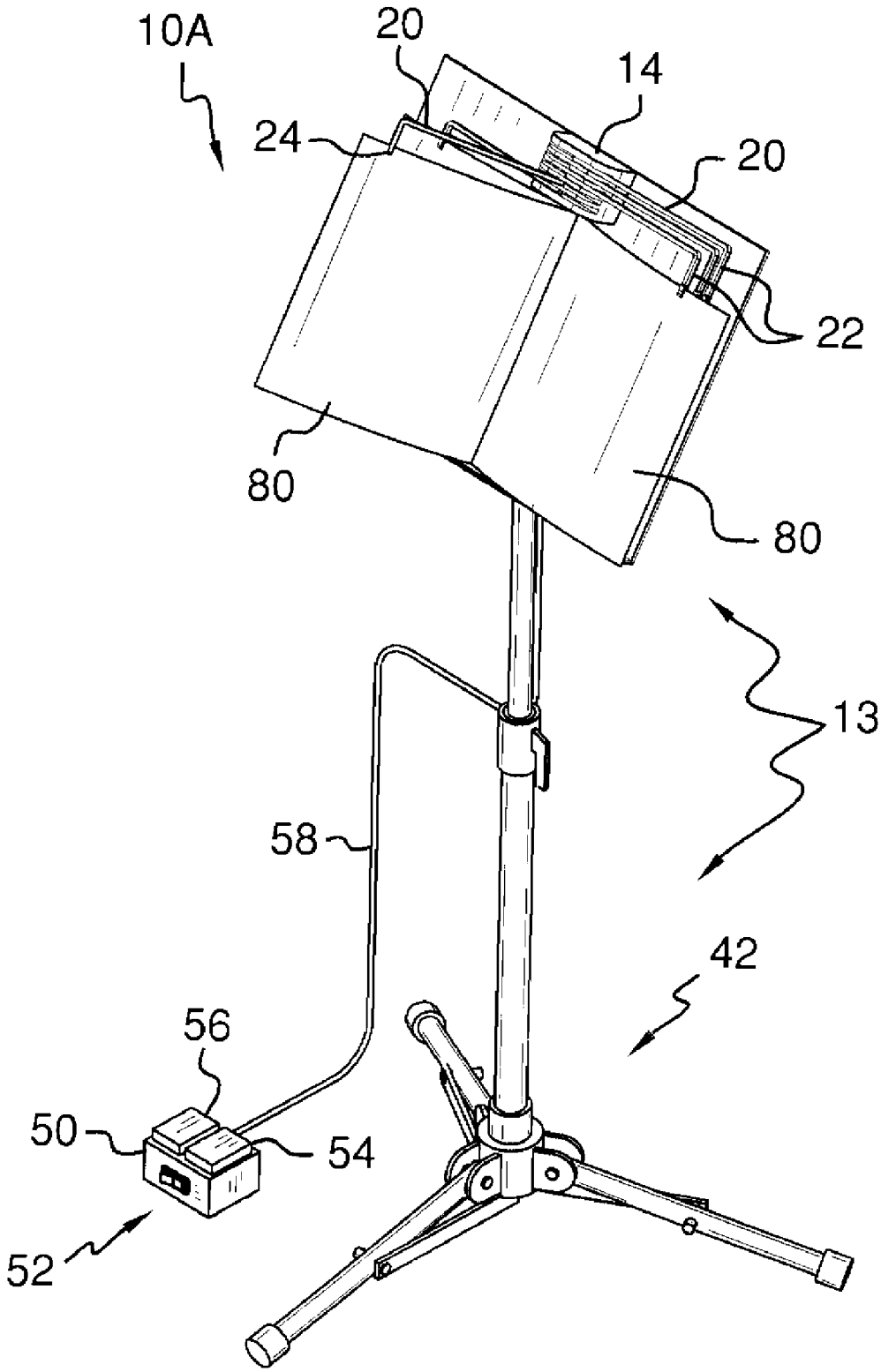
FIG. 3 is right isometric view of the apparatus with battery-powered control.

Referring to FIGS. 1, 2, and 3, the music page turning apparatus 10A embodiment comprises a music stand 13. The stand 13 further comprises a folding leg support 42. The support 42 comprises height adjustment and folding legs that are well known in the art. The platform 30 is positioned atop the stand 13. A lip 32 is disposed on the bottom of the platform 30 such that sheet music and music books are supported. The electric motor unit 14 is affixed to the top of the platform 30. The motor unit 30 comprises an internal bi-directional motor (not shown).

A plurality of horizontal slots 18 is disposed in a front face 17 of the motor unit 14. A plurality of progressively sized arms 20 is provided. Each arm 20 is slideably disposed within a slot 18 of the face 17. Each arm 20 is in communication with the motor of the motor unit 14. Each arm 20 is of a different length. The longest arm 20 is in the uppermost position. The shortest arm 20 is in the lowest position. A plurality of progressively sized arm angles 22 is provided. Each arm angle 22 is on a distal end of one of the arms 20. The longest angle 22 is on the longest arm 20. The shortest angle 22 is disposed on the shortest arm 20. Various mechanical and magnetic clips may be used to removably attach each arm angle 22 to a music page 80. The preferred attachment is the spring clip 24 illustrated. Limit switches (not shown) are within the motor unit 14 for limiting bi-directional movement of each arm 20. Limit switches are well known in the mechanical arts.

The control 50 controls the motor unit 14. The control 50 comprises a powering means. The preferred powering means is via standard electrical outlet power via power cord 60. The relay cord 58 provides communication between the control 50 and the motor unit 14. Still other embodiments of the apparatus 10A provide battery power within the control 50. The control 50 further comprises an on/off switch 52. The on/off switch 52 is preferably disposed, as illustrated, on the front of the control 50, such that a user's foot can easily trip the on/off switch 52 as desired. The control 50 further comprises means for directional control of the motor unit 14. Directional control is via a forward switch 54 and a reverse switch 56 which are preferably positioned atop the control 50 for easiest foot operation. The forward switch 54 turns music pages 80 in normal forward progression. The reverse switch 56 reverses the motor of the motor unit 14 to turn pages 80 in reverse progression. The bottom of the control 50 is fitted with non-skip pads 62 so that operation of the control 50 does not cause undesired movement.

Figure 4:
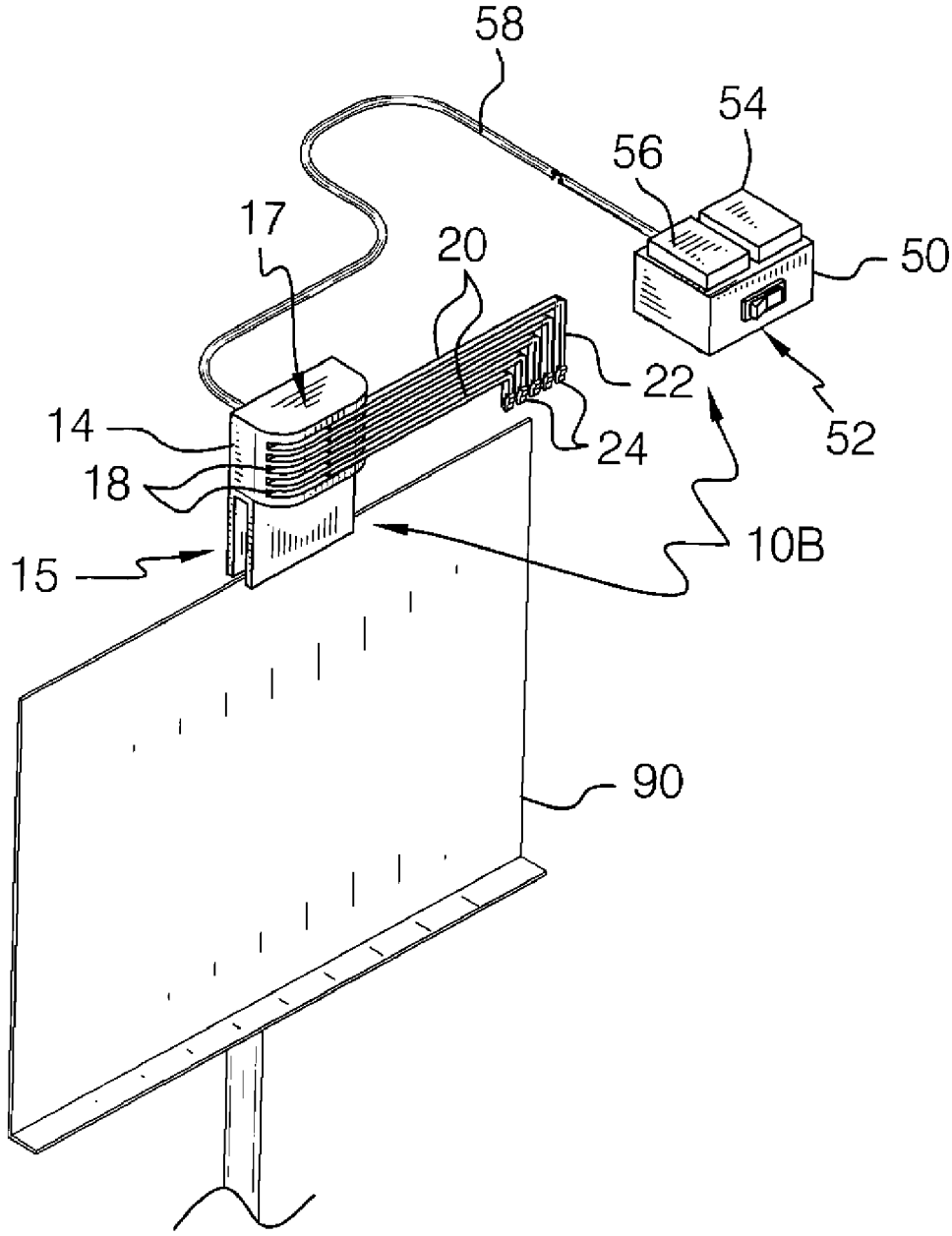
FIG. 4 is a perspective view of an alternative embodiment of the apparatus in association with an existing music stand.
Figure 5:
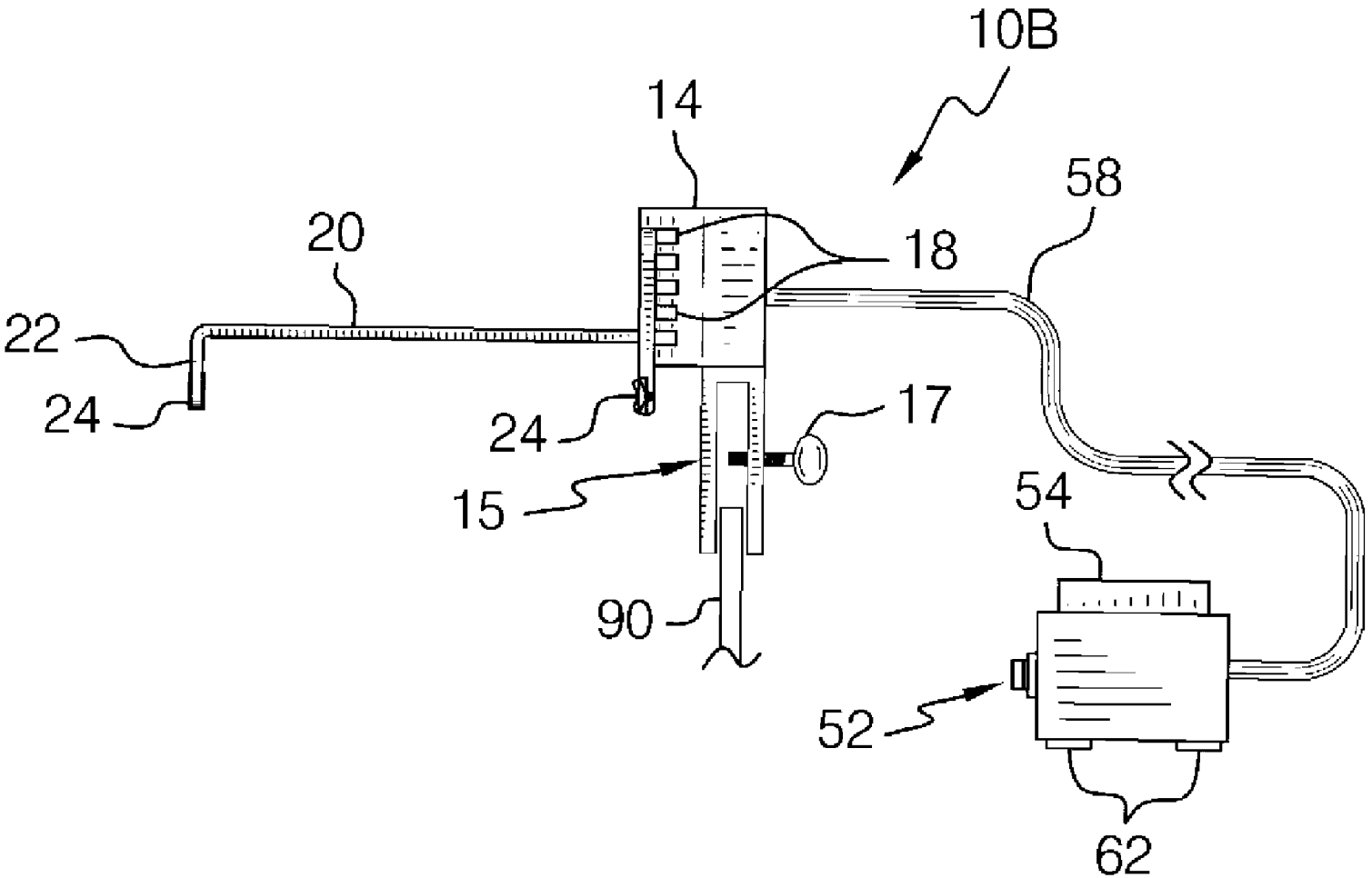
FIG. 5 is a side elevation view of the apparatus of FIG. 4.

Referring to FIGS. 4 and 5, the music page turning apparatus 10B embodiment is for fit to an typical existing platform 90. The apparatus 10B embodiment comprises an electric motor unit 14 to be removably affixed to the top of the existing platform 90. The motor unit 30 comprises an internal bi-directional motor (not shown). A plurality of horizontal slots 18 is disposed in the front face 17 of the motor unit 14. A plurality of progressively sized arms 20 is provided. Each arm 20 is slidably disposed within a slot 18 of the face 17. Each arm 20 is in communication with the motor of the motor unit 14. Each arm 20 is of a different length. The longest arm 20 is in the uppermost position. The shortest arm 20 is in the lowest position. A plurality of progressively sized arm angles 22 is provided. Each arm angle 22 is on a distal end of one of the arms 20. The longest angle 22 is on the longest arm 20. The shortest angle 22 is disposed on the shortest arm 20. Various mechanical and magnetic clips may be used to removably attach each arm angle 22 to a music page 80. The preferred attachment is the spring clip 24 illustrated. Limit switches (not shown) are within the motor unit 14 for limiting bi-directional movement of each arm 20. Limit switches are well known in the mechanical arts.

The control 50 controls the motor unit 14 via relay cord 58. The control 50 comprises a powering means. Powering means is, in one embodiment, via standard electrical outlet power via a power cord 60 (FIGS. 1 and 2). The embodiment of the apparatus 10B illustrated provides battery power within the control 50. The control 50 further comprises an on/off switch 52. The on/off switch 52 is preferably disposed, as illustrated, on the front of the control 50, such that a user's foot can easily trip the on/off switch 52 as desired. The control 50 further comprises means for directional control of the motor unit 14. Directional control is via a forward switch 54 and a reverse switch 56 which are preferably positioned atop the control 50 for easiest foot operation. The forward switch 54 turns music pages 80 in normal forward progression. The reverse switch 56 reverses the motor of the motor unit 14 to turn pages 80 in reverse progression. The bottom of the control 50 is fitted with non-skip pads 62 so that operation of the control 50 does not cause undesired movement.

The motor unit 14 is removably affixed to the music stand 13 platform via the u-clamp 15 with thumb screw 19. The u-clamp 15 fits on either side of the existing platform 90. The thumb screw 19 selectively secures the u-clamp.

Figure 6:
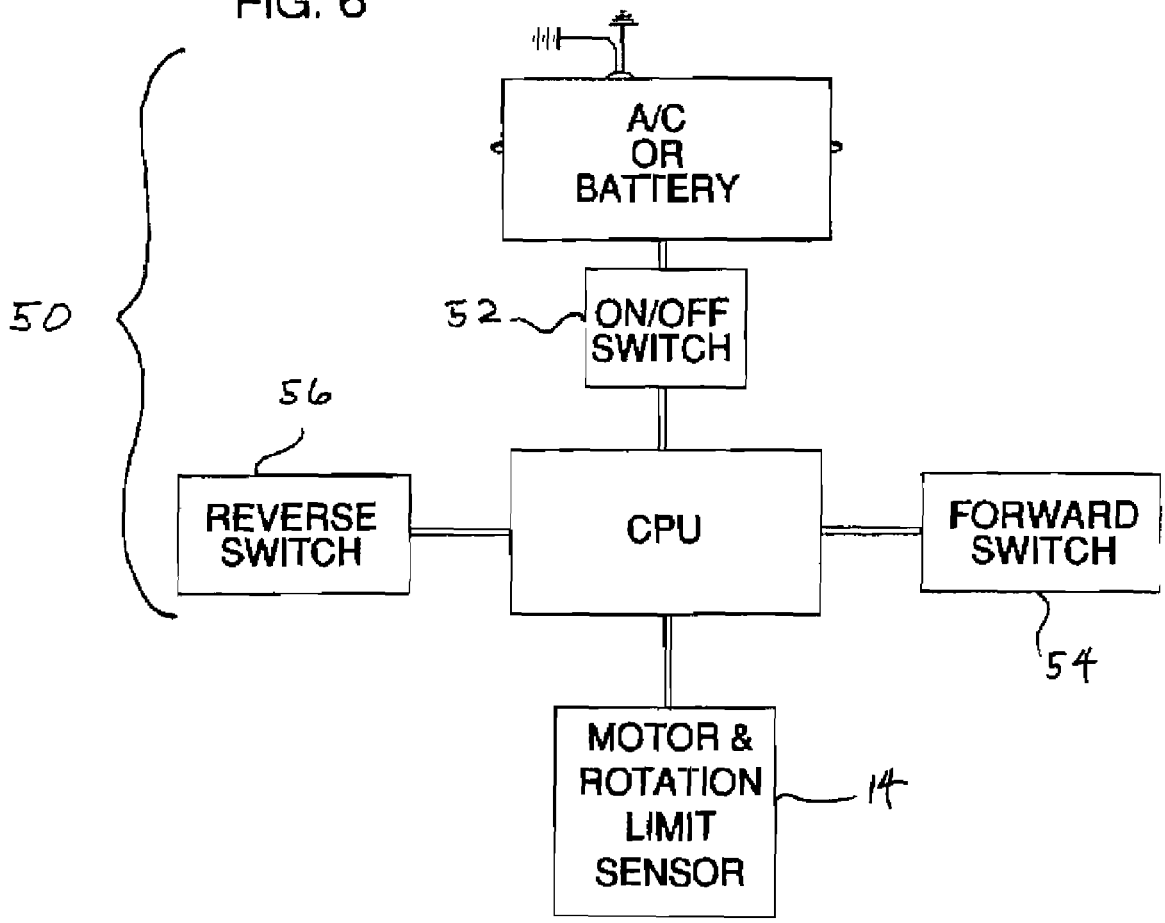
FIG. 6 is a schematic block diagram of the relationship of the motor unit and the control.

Referring to FIG. 6, the motor unit 14 also comprises rotation limit sensors, such that the arms 20 travel through specific arcs in turning pages 80 both forward and backward. The internal limit sensors of the motor unit 14 enable the arms 20 to scribe arcs as pictured in FIGS. 1 and 2, stopping pages 80 as needed. The CPU (computer processing unit) of the control 50 functions to process and dictate commands from the control 50 to the motor unit 14.

With respect to the above description then, it is to be realized that the optimum dimensional relationships for the parts of the music page turning apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the music page turning apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the music page turning apparatus may be used.

Therefore, the foregoing is considered as illustrative only of the principles of the music page turning apparatus. Further, since numerous modifications and changes will readily occur to those skilled in the art, it is not desired to limit the music page turning apparatus to the exact construction and operation shown and described, and accordingly, all suitable modifications and equivalents may be resorted to, falling within the scope of the music page turning apparatus.

What is claimed is:

1. A music page turning apparatus, comprising:

an electric motor unit, the motor unit comprising:

an internal bi-directional motor;

a plurality of slots, the slots disposed in a front face of the motor unit;

a plurality of progressively sized arms, each arm slideably disposed within a slot of the face, each arm in communication with the motor, each arm of a different length, the longest arm in an uppermost position, the shortest arm in a lowest position;

a plurality of progressively sized arm angles, each arm angle on a distal end of one of the arms, a longest angle on the longest arm, a shortest angle on the shortest arm;

means for removably attaching each arm angle to a music page;

limit switches for limiting bi-directional movement of each arm;

means for affixing the motor unit to a music platform;

a control for controlling the motor unit, the control comprising:

a powering means;

an on/off switch;

means for directional control of the motor unit.

2. The apparatus in claim 1 wherein the means for removably attaching each arm angle to a music page is a spring clip on a bottom of each arm.

3. The apparatus in claim 1 wherein the means for affixing the motor unit to a music platform comprises a u-clamp disposed on a bottom of the motor unit;

a thumb screw disposed on the u-clamp.

4. The apparatus in claim 2 wherein the means for affixing the motor unit to a music platform comprises a u-clamp disposed on a bottom of the motor unit;

a thumb screw disposed on the u-clamp.

5. The apparatus in claim 1 wherein the means for directional control of the motor unit comprises:

a forward switch;

a reverse switch.

6. The apparatus in claim 2 wherein the means for directional control of the motor unit comprises:

a forward switch;

a reverse switch.

7. The apparatus in claim 3 wherein the means for directional control of the motor unit comprises:

a forward switch;

a reverse switch.

8. The apparatus in claim 4 wherein the means for directional control of the motor unit comprises:

a forward switch;

a reverse switch.

9. The apparatus in claim 8 wherein the powering means is standard electrical outlet power.

10. A music page turning apparatus, comprising:

a music stand, the stand comprising:

a folding leg, adjustable height support;

a platform atop the support;

a lip on a bottom of the platform;

an electric motor unit affixed to a top of the platform, the motor unit comprising:

and internal bi-directional motor;

a plurality of slots, the slots disposed in a front face of the motor unit;

a plurality of progressively sized arms, each arm slideably disposed within a slot of the face, each arm in communication with the motor, each arm of a different length, the longest arm in an uppermost position, the shortest arm in a lowest position;

a plurality of progressively sized arm angles, each arm angle on a distal arm of one of the arms, a longest angle on the longest arm, a shortest angle on the shortest arm;

means for removably attaching each arm angle to a music page;

limit switches for limiting bi-directional movement of each arm;

means for affixing the motor unit to the platform;

a control for controlling the motor unit, the control comprising:

a powering means;

an on/off switch;

means for directional control of the motor unit.

11. The apparatus in claim 10 wherein the means for removably attaching each arm angle to a music page is a spring clip on a bottom of each arm.

12. The apparatus in claim 11 wherein the means for affixing the motor unit to the platform comprises a u-clap disposed on a bottom of the motor unit;

a thumb screw disposed on the u-clamp.

13. The apparatus in claim 12 wherein the means for affixing the motor unit to the platform comprises a u-clamp disposed on a bottom of the motor unit;

a thumb screw disposed on the u-clamp.

14. The apparatus in claim 13 wherein the means for directional control of the motor unit comprises:

a forward switch;

a reverse switch.

15. The apparatus in claim 14 wherein the means for directional control of the motor unit comprises:

a forward switch;

a reverse switch.

16. The apparatus in claim 15 wherein the means for directional control of the motor unit comprises:

a forward switch;

a reverse switch.

17. The apparatus in claim 16 wherein the means for directional control of the motor unit comprises:

a forward switch;

a reverse switch.

18. The apparatus in claim 17 wherein the means for directional control of the motor unit comprises:

a forward switch;

a reverse switch.

19. The apparatus in claim 18 wherein the powering means is standard electrical outlet power.

* * * * *